US006880494B2

(12) United States Patent
Hoose

(10) Patent No.: US 6,880,494 B2
(45) Date of Patent: Apr. 19, 2005

(54) TOROIDAL INTERNAL COMBUSTION ENGINE

(76) Inventor: Karl V. Hoose, P.O. Box 3, Waterboro, ME (US) 04087

( * ) Notice: Subject to any disclaimer, the term of this patent is extended or adjusted under 35 U.S.C. 154(b) by 0 days.

(21) Appl. No.: 10/624,310

(22) Filed: Jul. 22, 2003

(65) Prior Publication Data

US 2005/0016493 A1 Jan. 27, 2005

(51) Int. Cl.[7] ..... F02B 53/00; F01C 1/00

(52) U.S. Cl. ..... 123/18 A; 123/18 R; 123/245; 418/36; 418/33; 418/34

(58) Field of Search ..... 123/245, 248, 123/18 A, 18 R; 418/33, 34, 35, 36

(56) References Cited

U.S. PATENT DOCUMENTS

| | | | | | |
|---|---|---|---|---|---|
| 1,329,625 | A | * | 2/1920 | Noble | 418/36 |
| 3,087,671 | A | * | 4/1963 | Myles | 418/34 |
| 3,186,383 | A | * | 6/1965 | Potter | 418/35 |
| 3,644,069 | A | * | 2/1972 | Stewart | 418/33 |
| 3,645,239 | A | * | 2/1972 | Cena | 123/245 |
| 3,702,746 | A | | 11/1972 | Parmerlee | 123/18 R |
| 3,990,405 | A | * | 11/1976 | Kecik | 418/36 |
| 4,086,879 | A | | 5/1978 | Turnbull | |
| 4,434,751 | A | | 3/1984 | Pavincic | |
| 4,662,177 | A | * | 5/1987 | David | 123/18 A |
| 4,679,535 | A | | 7/1987 | Stadden | |
| 5,009,206 | A | * | 4/1991 | Yi | 123/248 |
| 5,233,954 | A | | 8/1993 | Chomyszak | |
| 5,404,850 | A | | 4/1995 | LaBell, Jr. | |
| 6,071,098 | A | | 6/2000 | Richards | |
| 6,321,693 | B1 | | 11/2001 | Kim et al. | |
| 6,668,787 | B1 | * | 12/2003 | Masters | 123/245 |
| 6,691,647 | B1 | * | 2/2004 | Parker | 123/18 A |

FOREIGN PATENT DOCUMENTS

| | | | | |
|---|---|---|---|---|
| DE | 3825354 A1 | * | 2/1990 | F01C/1/02 |
| EP | 83892 A2 | * | 7/1983 | 418/33 |

OTHER PUBLICATIONS

Rotary Engines, by Wallace Chinits. in: Scientific American, pp. 90–99, Feb. 1969.

Construction and Operation of the Bradshaw Omega Engine, by David Scott, in: Automotive Industries, pp. 54–55, Jan. 15, 1956.

www.appliedthermalsciences.com/projects/ic_engine.htm.

IC Engine Concepts, 2001.

* cited by examiner

*Primary Examiner*—Thai-Ba Trieu

(74) *Attorney, Agent, or Firm*—Patricia M. Mathers; Thomas L. Bohan

(57) ABSTRACT

Toroidal internal combustion engine comprising two concentric engine rings. Intake valves are assembled in two faces of one set of pistons and exhaust valves in two faces of the second set of pistons. The intake-valve pistons are fixedly attached to one of the engine rings and the exhaust-valve pistons to the other engine ring. The face of one intake-valve piston and the face of one adjacent exhaust-valve piston form boundaries of an engine chamber. Combustion forces on the piston faces force the two concentric engine rings to counter-rotate. The intake-valve piston and the adjacent exhaust-valve piston sweep the same chamber volume at different strokes of the engine cycle. The engine is constructed of CRC material and mounted on a central shaft, with the intake manifold and the exhaust manifold mounted on each side of the engine, providing a lightweight, self-lubricating, highly fuel efficient, and dynamically balanced engine.

27 Claims, 8 Drawing Sheets

TOROIDAL INTERNAL COMBUSTION ENGINE

BACKGROUND INFORMATION

1. Field of the Invention

The field of the invention relates to internal combustion (IC) engines. More particularly, the invention relates to toroidal internal combustion engines.

2. Description of the Prior Art

The traditional reciprocating IC engine has been around for more than 100 years, yet its design has several inherent disadvantages. One major disadvantage is that the energy released by combustion is converted work via linearly moving pistons and is then converted to rotational work output when it is transmitted to the crankshaft. This transfer of work output from linear to rotational motion is inherently inefficient for several reasons. For one, the slider crank mechanism that receives the work output from the piston is not at an optimum position for producing high torque on the crankshaft when pressure in the combustion chamber peaks and, consequently, only a portion of the energy generated by the combustion process is transmitted to the crankshaft, with the rest being dissipated in side thrust resulting in frictional work. Piston rings are used to provide a seal between the pistons and the cylinder wall, and also absorb the side thrust of the pistons that results from the slider crank configuration. With this configuration, the scraping action of the piston assembly, i.e., piston and piston rings, along the cylinder wall accounts for 50–70% of the total friction losses of this engine design.

The poppet valves typically used in the reciprocating IC engine are also sources of energy loss for several reasons. First, they are subject to high friction, noise, and vibration, all of which dissipate energy. The typical valve configuration, in which both intake and exhaust valves are located in close proximity to each other in the cylinder head, is also a source of energy loss during valve overlap. During valve overlap, in which both valves are open at the same time for at least a portion of a stroke, some of the fresh charge being drawn into the cylinder escapes directly through the exhaust valve, thereby reducing the mass of fuel-air mixture entering the cylinder. The heat transfer from the exhaust gas to the incoming charge also contributes to the reduction in mass of fresh charge available for combustion.

Rotary or toroidal IC engine designs have been investigated in the past in an attempt to overcome some of the inherent shortcomings of the traditional reciprocating IC engine. Rotary engines include designs with reciprocating pistons within a rotating housing, such as the Selwood Orbital and Bradshaw Omega toroidal engines, as well as cat-and-mouse piston designs, such as the Tschudi and Kauertz engines, in which pistons travel with variable velocity in a circular path. Toroidal engines have some distinct advantages over the traditional reciprocating piston engine, such as excellent balance (Selwood and Bradshaw Omega), absence of valve mechanisms, small size, and high power-to-weight ratio. The Wankel engine, an eccentric, three-chamber rotary engine, has perhaps found the most success with its simple design and small size. Despite these advantages, problems of nonuniform heating, sealing, inertia effects, and/or lubrication have prevented these engines from taking hold in the market place. These and other rotary engines are described in: Chinitz: Walter; Rotary Engines, *Scientific American*, February 1999, pp. 90–99.

A number of toroidal engines of the prior art teach a toroidal construction in which a pair of rotors that operate in parallel, but spaced-apart planes are enclosed within a housing. Piston vanes are integrally formed or mounted on the rotors, with the faces of the vanes forming increasing or decreasing chambers as the rotors counter-rotate, i.e., rotate in opposite directions. Parmerlee (U.S. Pat. No. 3,702,746; 1972) discloses such a toroidal engine that is a free-piston gas generator. Intake and exhaust ports are provided in the wall of the housing, as are bypass recesses. Simultaneous combustion in two chambers, spaced 180 degrees apart, forces the vanes on each rotor that bound the combustion chamber to move apart, thereby causing the rotors to rotate and simultaneously increase the combustion and intake chambers and decrease the compression and exhaust chambers. Ports and/or bypass recesses are situated in the housing such that they are appropriately opened or closed by the side walls of the vanes as they rotate within the housing. Kim (U.S. Pat. No. 6,321,693; 2001) also discloses an internal combustion engine having a rotor-piston-housing configuration similar to that of Parmerlee. In the Kim engine, intake and exhaust valves are placed in close proximity to each other on the housing, spaced 90 degrees apart. These engines solve some of the inefficiencies and force-balance problems inherent in a linearly reciprocating piston engine design that converts work output to rotary motion, because combustion is simultaneously taking place at two places 180 degrees apart within a torus. However, due to the configuration and engine construction, the forces exerted on the rotors and, thus, the housing are very high and will necessarily require very high-performance seals, problems that the designs of these engines do not solve. None of the disclosures for the toroidal engines of the prior art addresses cooling techniques to prevent overheating, warping, or destruction of the engine during routine operation.

What is needed, therefore, is an IC engine that provides superior performance with greater efficiency and reduced emissions. What is further needed is such an engine that is lighter in weight, smaller in size, and has fewer moving parts. What is yet further needed is such an engine in which the mechanical forces are dynamically balanced and the thermal stresses evenly distributed. What is still yet further needed is such an engine with reduced loads and requirements on seals, lubrication, and cooling.

BRIEF SUMMARY OF THE INVENTION

For the reasons given above, it is an object of the present invention to provide an IC engine that provides superior performance and reduced emissions. It is a further object to provide such an engine that has fewer moving parts, is lighter in weight, and small in size than a conventional IC engine of comparable power. It is a yet further object to provide such an engine in which the mechanical forces are dynamically balanced and the thermal stresses evenly distributed. It is a still further object to provide such an engine that requires fewer and simpler seals and has reduced requirements for cooling and lubrication.

The above-cited objects have been achieved by providing a toroidal IC engine with free-moving pistons within an engine ring that is a torus. The torus is formed of two concentric rings, an inner engine ring and an outer ring. The two rings are sealed along two ring seams to form the complete torus. One set of pistons is affixed to the outer ring and another set of pistons is affixed to the inner engine ring. The pistons of each set are at a fixed interval relative to each other. The torus thus forms the chamber walls and the faces of the pistons form the boundaries of the chambers within the torus. Pressure applied to the faces of pistons forces the pistons to move, with the result that the inner and outer rings of the torus counter-rotate relative to one another and the pistons slide in the torus along the walls of the ring to which they are not affixed. For purposes of illustration and simplicity, the toroidal IC engine according to the present invention will be described hereinafter as being a four-stroke engine having eight pistons and eight chambers. Thus, four of the eight pistons are affixed to the outer ring at 90 degree intervals, and the four other pistons are affixed to the inner engine ring, also at 90 degree intervals. In an engine of this configuration, the torus contains two chambers for each stroke of the 4-stroke cycle, that is, two combustion chambers, two intake chambers, two compression chambers, and two exhaust chambers. Any two chambers going through the same stroke are spaced 180 degrees apart on the torus. When combustion occurs, the pressure change forces the two pistons bounding the two combustion chambers apart, effectively forcing the two rings to counter-rotate. Because the four pistons on a ring are fixed in a 90-degree spatial relationship to each other, the pressure changes in the two combustion chambers simultaneously force four chambers to increase and four chambers to decrease in volume. It should be understood that this engine is configurable with any number of pistons greater than one, depending on the size and power requirements of the engine. For example, the toroidal IC engine may also be constructed as a 2-stroke engine with six pistons. In this case, at any one stroke of the engine cycle, three chambers of the six chambers are combustion chambers and are fixed in a 120-degree spatial relationship to each other on the engine ring.

In the engine according to the invention, the inlet and exhaust valves are assembled directly on the piston faces, with one valve only on each face. Each piston has two faces and, ideally, either an exhaust valve or an intake valve is assembled on each face of a piston and all pistons with intake valves are assembled on one ring and all pistons with exhaust valves on the other ring. This arrangement simplifies the construction of the engine because each piston requires only one connection to the respective intake or exhaust maniforld and all pistons on one ring are fed from the same manifold. Thus, all pistons connected to one ring allow the introduction of a fresh charge into the engine, while all pistons connected to the other ring allow exhaust products to exit the engine. This construction provides the further advantage that the fresh air charge enters through a piston face at one end of the chamber and the exhaust gases exit through a piston face at the other end of the chamber. This arrangement reduces the portion of fresh air charge being swept out through the exhaust valve during any intake and exhaust valve overlap and improves scavenging (the elimination of exhaust gas) and control over the amount of fresh charge taken in during the intake stroke. Placing the intake and exhaust valves at opposite sides of the chamber also enhances mass flow into the engine, because the intake valve stays cooler than in the traditional valve arrangement in which intake and exhaust valves are placed close together on the cylinder head. Furthermore, by forcing the fresh air into one end of the chamber while venting exhaust at the other end of the chamber, fresh air bathes and cools the exhaust valve only after it has entered one end of the chamber and traveled to the opposite end.

Placing only one valve on a piston face provides a greater surface area available for the valve and makes it possible to use types of valves other than the traditional poppet valve. The valve types most suitable to the toroidal IC engine are slider or slot valve types. Valve systems using these types of valves allow faster opening and closing operation and are much lighter, smaller, and require less energy to operate than conventionally used poppet valve or sleeve valve systems. Preferably, the valves are hydraulically, pneumatically, or electromechanically controlled, as the actuation has shown to be fast, efficient, and light for similar applications, such as the operation of clutches. With these three actuation types, all valves are independently actuatable, allowing optimization of the engine under various conditions, which further contributes to increased performance and decreased emissions. As described earlier, the intake and exhaust valves are on opposite sides of the chambers, providing optimal scavenging for both two and four stroke cycle modes (no piston contouring needed), and enabling independently operable valves as a function of piston position. This independent operation of the valves, along with their ideal placement on the piston face, allows the engine to be switched from a four stroke to a two stroke mode during operation. This capability theoretically doubles the power output of the engine, nearly instantaneously, without an increase in engine speed. This opens up the possibility of an entire new class of engines having dual-cycle-mode operating characteristics. The power-to-weight ratio of the engine is again doubled, having a major impact on the power output range of the toroidal IC engine according to the invention. In addition, ability to independently operate the valves enables optimization of valve time as a function of engine speed and load, and this further reduces emissions. The power-to-weight ratio of the engine is doubled again, having a major impact on the power output range of the toroidal IC engine. Note that the engine is still dynamically balanced in both the four or two stroke cycle modes, because the combustion strokes occur at every 90° in the described configuration.

Since only one valve is placed on the piston face, the entire surface area of the piston face is available as working surface for the valve. The surface area is sufficiently large that it is possible to place an appropriate device in the center of the piston face for spark-ignition or fuel injection. Placing the spark plug in the center of the piston face has the advantage that is provides the shortest possible flame travel during combustion. This has proven to prevent detonation and decrease emissions in the engine. For compression ignition engines, the direct fuel injection would ideally be located near the center of a piston face.

The toroidal IC engine according to the invention requires two different types of seals, a piston seal and a ring-seam seal. The engine ring-seam seal has two major tasks which prescribe a different design than that of the piston ring seal in the traditional engine. First, the engine ring-seam seal must act as a sliding surface for the inner and outer engine rings and prevent blowby of high pressure gas from the combustion chambers to the surrounding area outside the torus. Second, the engine ring seam seal must provide a gas seal between adjacent chambers. It is known that the o-rings used in the past inherently lead to leakage. The seal requirements for the toroidal IC engine are very different. For one thing, combustion occurs evenly around the toroidal IC engine, which reduces thermal stresses in the engine torus and, thus, prevents engine warping. The engine is also constructed from advanced composites having a low thermal expansion coefficient, which further reduces thermal stresses and prevents engine warping. The lack of side thrust, the low thermal expansion coefficient, and the known self-lubricating characteristics of advanced composite materials (to be discussed below) make it possible to operate the toroidal IC engine without an O-ring-type seal at the engine ring seam and without the traditional oil lubrication system.

The ring seam on the engine torus is constructed to be self-sealing, that is, the seam surfaces on the inner and outer rings are machined to act in a self-sealing manner. The pressures on the inside surface of each engine ring have a resultant force in opposite directions, which effectively forces the seam surfaces together. Ideally, the seam surface on the inside of the chamber is flush with the cross section of the torus shape. When the piston passes over the ring-seam seal, there is no gap for high pressure gas to leak through into the adjacent chamber. This design requires that the engine ring seam surfaces be accurately and precisely machined to obtain even surface contact around the inner circumference of the torus.

If precise machining is not practical or economically feasible, a flexure piece may be used to provide the ring-seam seal. A small slit or cavity is cut into one of the two surfaces of each seam to form a flexure piece. Flexion in this small piece allows the seal surface to flex/bend slightly to form a seal against the adjacent surface of the ring seam. Note that the flexion of this piece is effected during high pressures in the chamber. The appropriate size and location of the slit is dependent upon the material properties and anticipated irregularities in the seam surfaces. It is also within the scope of the present invention to provide a separate engine ring seam seal. The advantage of using a separate engine ring seal is that the wear resulting from the motion of the inner and outer engine rings is carried by the seal and, thus, wear on the engine ring is minimal. It is, of course, much more economical to replace the engine seal, rather than the engine ring. The applicant has determined that a separate seal with a delta geometry crossection provides excellent sealing characterisitics.

The pistons are machined to fit with minimal clearance within the torus cross section, with one half of the piston being rigidly attached to either the inner or the outer engine ring and and the other half fitted with an integrated seal that will allow the piston to slide in the other engine ring, while maintaining a sealed chamber. Thus, the pistons are not fitted with an independent ring seal. As mentioned above, the engine ring and the pistons are constructed of composite materials. Because the thermal expansion coefficient of the composite materials is very low and the pistons and engine rings are machined to close tolerances, the pistons provide an adequate seal between the chambers without requiring separate piston seals. Ringless pistons provide the advantage of reduced friction, as the absence of piston rings eliminates additional piston ring friction resulting from increased cylinder pressure during combustion, and also reduces emissions, as there is no gap between piston and chamber wall to harbor unburned fuel.

The toroidal IC engine according to the invention is operable in a two or four stroke cycle mode, with spark ignition or compression ignition. The following is a brief summary of the four stroke, compression ignition cycle operation. Refer also to FIGS. 3A–3D. The eight chambers are designated around the torus as A,A'; B,B', C,C', and D,D'. At this beginning point in the description, combustion has just taken place in chambers A,A'; chambers B,B' are compression chambers, chambers C,C' intake chambers, and D,D' are exhaust chambers. When chambers A,A' reach full expansion, Bottom Dead Center (BDC), the exhaust valves in chambers A,A' open and chambers A,A' begin the exhaust stroke. Chambers B,B' are now in the power stroke, chambers C,C' in the compression stroke, and chambers D,D' in the intake stroke. In the next stroke, chambers C,C' will be in the power stroke, and so forth. Two chambers 180 degrees apart undergo a power stroke for each stroke of the engine, and those two chambers provide the energy to effect the strokes in the other chambers. This process continues until all the chambers go through the complete four stroke cycle, (power, compression, intake, exhaust) and the cycle then repeats continuously. The inner and outer rings reciprocate back and forth at each stroke of the engine, i.e., four times in one complete four-stroke cycle.

The reciprocating action of the pistons in the torus allows adjacent pistons to share chamber volume. Thus, the swept volume (engine displacement) of the toroidal IC engine of the present invention is substantially double that of a conventional engine with the same volume. For example, an engine having a torus diameter of 12 inches measured from seam to seam, a piston-face diameter of 3.5 inches, and a piston thickness of 3.0 inches will have 263 cubic inches of swept volume. The swept volume is essentially equal to twice the actual volume of the engine (volume of the eight chambers), assuming an infinite compression ratio.

The geometry of the torus and the fact that combustion occurs simultaneously at two locations 180 degrees apart and in all chambers around the torus in the course of the four-stroke cycle, are factors that contribute to a dynamically and thermally balanced engine. During combustion, the pressure applied to the chamber walls tends to force the inner and outer rings apart at that location. The shape of the torus and a self-sealing construction of the ring seam, however, hold the rings together. The self-sealing effect results from the fact that the ring seam is designed such that the equal but opposite forces on the engine rings force the seam edges against each other to effect a tighter seal, rather than forcing them apart. In addition, the forces on the chamber walls (inner and outer ring walls) during combustion in one chamber cancel out the forces from the other chamber 180 degrees out. This attribute eliminates adverse forces on the engine mounting shaft, resulting in reduced friction (higher thermal efficiency) and a completely balanced engine during operation. In addition, the reduced friction reduces wear and lubrication requirements, increases reliability, and reduces maintenance.

The mass inertia of the inner and outer rings is balanced so that the momentum of the rings during the rotation is essentially the same. This and the fact that the rings counter-rotate and that the rotation stops and starts at the same time eliminates adverse inertia effects, such as are inherent in the Tschudi and Kauertz engines. The toroidal IC engine of the present invention is dynamically balanced, with much reduced vibration and smoother operation. Furthermore, the inertia loads on the torus (including the pistons) are opposed by the pressures in the combustion and compression chambers, instead of being absorbed by connecting rod-crankshaft bearings, as in the traditional reciprocating design. By contrast, the configuration of the Kim design has axially opposing side walls. The forces on the walls translate into friction forces on the sliding surface, which reduces efficiency.

Inherent in the design of the toroidal IC engine according to the invention is uniform heating of the engine. This is because combustion occurs once in all chambers of the toroidal IC engine in the course of operation of a full cycle. With reference to a four-stroke cycle engine with eight chambers, combustion occurs in each of the eight chambers once in the four-stroke cycle. This intermittent heating at eight equally spaced positions around the torus results in uniform heating and significantly reduces thermal stress on the engine.

Ideally, the toroidal IC engine of the present invention is constructed entirely of carbon-reinforced carbon (CRC)

material. The thermal expansion of the CRC material is extremely low, thus, engine warping due to nonuniform heating is minimal. The CRC material has the potential to reduce the weight of the engine on average by a factor of two or more. It is known that carbon-carbon composite materials have oxidation problems at elevated temperatures. To avoid this problem, the engine is coated, in oxygen exposed areas, with a suitable coating, such as silicon carbide, which prevents oxidation and provides additional insulative properties. The CRC material and the coating drastically reduce the cooling requirements of the engine. In addition, the advanced materials allow higher operating temperatures, which reduces heat transfer losses and results in a higher fuel conversion efficiency of the engine. The use of the CRC material plays a significant role in the ability to switch from a 4-stroke to a 2-stroke operating mode and still retain thermal equilibrium while operating. This is because the CRC material allows higher operating temperatures, whereby the 2-stroke mode requires the higher operating temperatures because it undergoes twice as many combustion strokes as the 4-stroke does in one cycle.

The combination of uniform heating, the extremely low thermal expansion of the CRC material, and the fact that all combustion chamber walls are surrounded by air makes this toroidal IC engine ideal for air cooling. Elimination of a water cooling system further reduces the weight and size of the engine, while increasing its reliability. This, together with the weight savings due to engine design mentioned above, provides a potential increase in power-to-weight ratio of this toroidal IC engine over the traditional engine design of at least 6:1.

As with traditional free piston engines, the compression ratio of the toroidal IC engine of the present invention is variable and is dependent upon the ignition point of the fuel and/or fuel injection for both spark and compression cycle modes. This characteristic allows optimization of the operating cycle (increased thermal efficiency) based on the type of fuel utilized, reducing both fuel consumption and emissions. Unlike the traditional free piston engine, the toroidal IC engine does not rely on a bounce cylinder to return the piston on compression, which severely limited the speed/power output of the conventional free piston engine. Since combustion occurs on both sides of the pistons, the engine is capable of much higher operating speeds. In addition, the engine is operable in a four stroke or two stroke cycle mode, whereas the traditional free piston engine operates strictly on the two stroke cycle. Note that the inner and outer rings must be linked to ensure that they move with the same angular velocity and acceleration. This is necessary in order for the mass inertia of the reciprocating rings to balance each other out for smooth operation, and to keep the rings from rotating around the center shaft. A mechanism similar to a dual rack and pinion gear, in which one rack is connected to the outer ring, the other rack to the inner engine ring, is a suitable mechanism for linking the two racks together to ensure that both rings move through the same angle of rotation. The movement of the pinion is used to measure the location of the rings during operation. Note that no load is to be extracted by this mechanism and, hence, a small, fine tooth gear system is suitable for effective operation.

Ideally, the toroidal IC engine according to the invention is mounted on a central shaft, along with intake and exhaust manifolds that have passages that connect to the intake and exhaust valves, respectively, in the pistons. The exhaust passages head from the pistons toward the center shaft. This provides an ideal arrangement for installing a turbocharger/turbocompounding/turboalternator unit with radial flow compressor and turbine. The compressor and turbine are aligned on the same center shaft as the engine, resulting in a very compact and light weight system.

The toroidal IC engine according to the invention decreases the actual total chamber length (cylinder volume) by 50% because adjacent pistons share chamber space. In addition, cylinder heads, crankshaft, or connecting rods are eliminated. Hence, weight and size of the engine are radically reduced, each by approx. 70%. Because of the substantially lower friction losses, the toroidal IC engine of the present invention produces more power than a conventional slider crank engine for the same volume displacement. This attribute alone increases the power-to-weight ratio of the toroidal IC engine by greater than a factor of three. This in turn reduces the weight of the vehicle, which translates into lower fuel consumption and reduced emissions.

One major difference between compression ignition engine and spark ignition is the compression ratio. Compression ignition requires higher compression ratios for auto-ignition of the fuel to take place. Since the compression ratio of the toroidal IC engine according to the invention is variable, the engine is operable in either mode. Unlike the traditional diesel engine, which is much heavier than the spark ignition engine, the toroidal IC engine does not require a significant change in engine housing construction in order to accommodate a variable compression ratio feature that allows the toroidal IC engine to switch between low and high compression ratios. This is because of the elimination of the cylinder head of the traditional design. In the toroidal IC engine, the forces on the engine rings do not increase at high compression ratios because the area of the exposed engine ring decreases linearly with the compression ratio. As a result, the forces remain nearly constant in an engine with a variable compression ratio. Auto-ignition temperatures vary for different fuels and the variable compression ratio feature of the engine automatically optimizes the engine cycle, based on the type of fuel used.

Various methods of power extraction are suitable for the toroidal IC engine according to the invention and are not discussed to any extent herein. The most suitable method of power extraction will depend to some extent on the particular application of the engine. Three different suitable methods of extracting energy from the engine are: a mechanical power train, an exhaust turbine, or an electric alternator.

BRIEF DESCRIPTION OF THE DRAWINGS

The present invention is described with reference to the accompanying drawings. In the drawings, like reference numbers indicate identical or functionally similar elements.

DETAILED DESCRIPTION OF THE INVENTION

Figure 1:
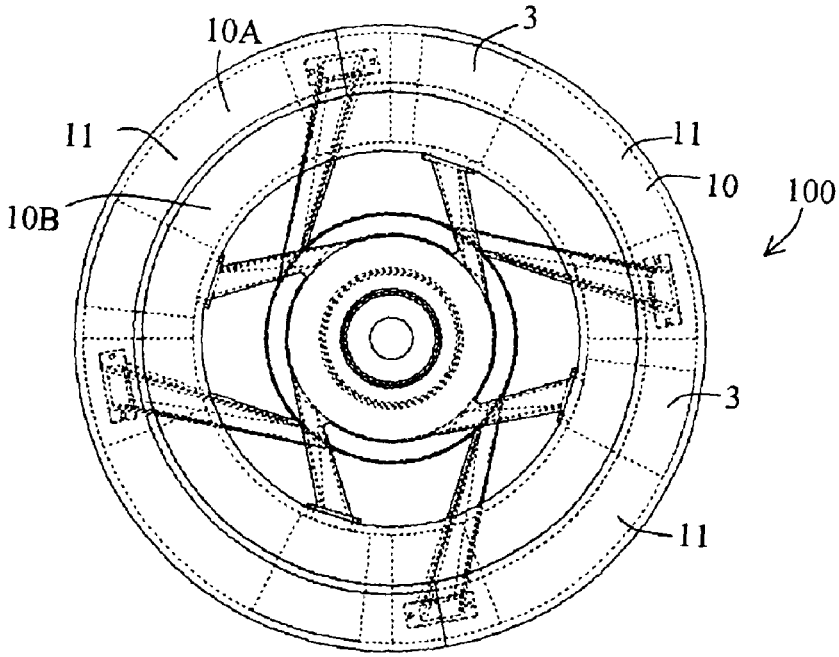
FIG. 1 is a schematic illustration of the toroidal IC engine according to the invention.

FIG. 1 is a schematic illustration of a toroidal IC engine 100 according to the invention. The toroidal IC engine 100 comprises an engine ring 10 with a plurality of pistons 3. For purposes of illustration and simplicity, the description of the toroidal IC engine 100 will be based on a four-stroke engine having eight pistons 3 and eight chambers 11. It should be understood, however, that the toroidal IC engine 100 is configurable as a two-stroke or a four-stroke engine, with any number of pistons greater than one, depending on the size and power requirements of the engine.

Figure 2A:
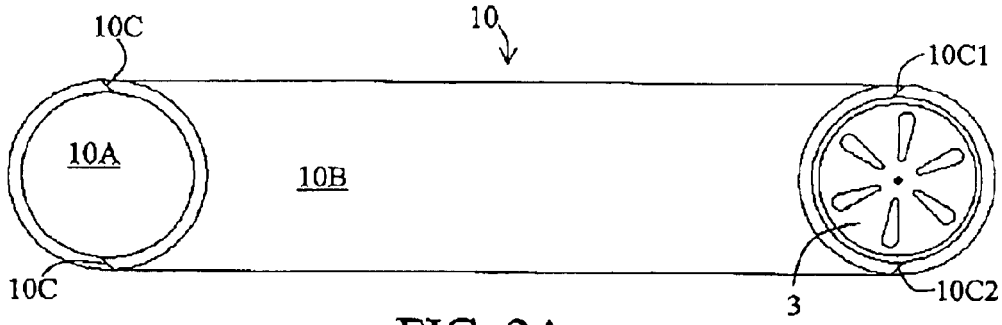
FIG. 2A illustrates the inner and outer engine rings seamed together to form the torus.
Figure 2B:
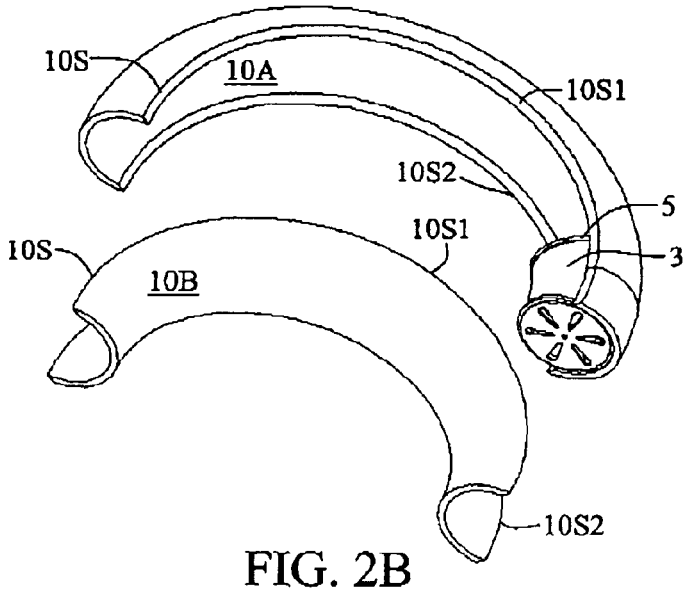
FIG. 2B shows partial sections of the inner and outer engine rings.
Figure 2C:
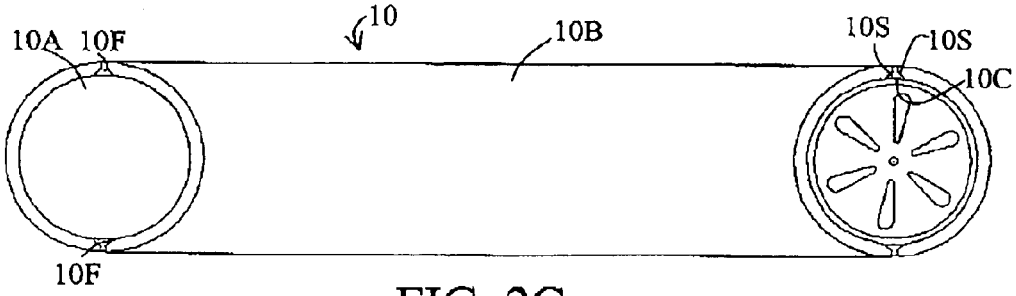
FIG. 2C is an illustration of an engine ring seal with a delta geometery.

FIGS. 2A–2B illustrate the basic construction of the engine ring 10. The engine ring 10 is a split ring having an outer engine ring 10A and an inner engine ring 10B. As shown, both the inner and outer engine rings 10B, 10A are C-shaped and have seam edges 10S which include a first seam edge 10S1 and a second seam edge 10S2. The outer engine ring 10A and inner engine ring 10B are joined together along the two seam edges 10S to form the engine ring 10 Note that for assembly, at least one of the engine rings 10A, 10B will have to be pieced together. In the embodiment of the engine ring 10 shown in FIGS. 2A–2B, one seam edge 10S of the inner engine ring 10A mates with one seam edge 10S of the corresponding outer engine ring 10B to form the engine ring seam 10C that is a self-sealing seam. Thus, the engine ring 10 has two seams 10C1 and 10C2 as shown. The surfaces at the ring seams 10C are cut diagonally through the thickness of the inner and outer engine rings 10B and 10A. When similar diagonal cuts are made on both seam edges 10S in the same direction, the inner surface area of inner engine ring 10B will be larger on one side, while the inner surface area of the outer engine ring 10A will be larger on the opposite side. Hence, when the engine rings 10A, 10B are assembled and pressurized, a resultant force on the inner engine ring 10B will be equal but opposite to the force on outer engine ring 10A. As best shown in FIG. 2A, the opposing forces from each engine ring 10A, 10B squeeze the seam surfaces 10C together on both sides, thereby effectively sealing the seams 10C from leakage.

Each chamber 11 is bounded by two pistons 3 in the torus 10. As shown in FIG. 2A, the cross-sectional area of the pistons 3 corresponds substantially to the internal cross-sectional area of the torus 10, such that the pistons 3 provide an effective seal between the chambers 11. As mentioned above, this description of the toroidal IC engine 100 is based on a four-stroke engine having eight chambers. Accordingly, the pistons 3 include, four intake-valve pistons 2 and four exhaust-valve pistons 4. Note that in the following description, the reference designation 3 shall refer to a piston in general, that is, regardless of its function as an intake-valve piston 2 or an exhaust-valve piston 4. The intake-valve pistons 2 are mounted on the concave (inside) wall of the inner engine ring 10B, spaced 90 degrees apart. Similarly, the exhaust-valve pistons 4 are mounted on the concave wall of the outer engine ring 10A, also spaced 90 degrees apart. Each of the pistons 3 is connected via a port to a passage that connects to a manifold, thus, the intake-valve pistons 2 are connected to an intake manifold 20 and the exhaust-valve pistons 4 to an exhaust manifold 40. These connections will be discussed below.

FIGS. 3A–3D illustrate the changes in size of the eight chambers 11 throughout the four-stroke engine cycle. The eight chambers 11 include; two combustion chambers 12A, 12B; two intake chambers 14A, 148; two compression chambers 16A, 16B, and two exhaust chambers 18A, 18B. Note that in the following description, reference designation 11 shall refer to a chamber in general, regardless of its function during the engine cycle. Each chamber 11 is bounded by two pistons 3, one being the intake-valve piston 2, and one the exhaust-valve piston 4. For the sake of clarity, the pistons 2,4 are shown without the manifolds 20,40. During operation, pressure changes occurring in the chambers 11 act against the faces of the pistons 3. For example, when combustion occurs in the two combustion chambers 12A, 12B, the intake-valve pistons 2 and the exhaust-valve pistons 4 bounding the two combustion chambers 12A, 12B are forced apart, causing the outer engine ring 10A and the inner engine ring 10B to move in opposite directions, that is, to counter-rotate as indicated by ring-rotation arrows 6A and 6B. For illustration purposes only, pairs of chambers, independent of stroke cycle, are identified in FIGS. 3A–3D as A,A'; B,B'; C,C'; and D,D'.

Figure 3A:
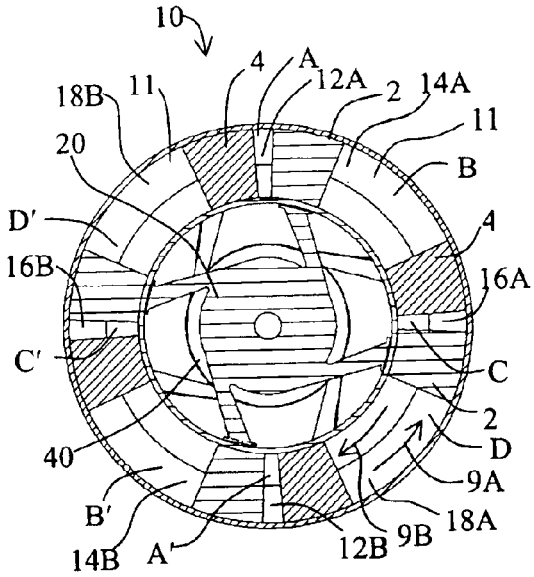
FIGS. 3A–3D illustrate the positions of the pistons and chambers through the four-stroke engine cycle.

Each of the FIGS. 3A–3D illustrates the relative position of the chambers 11 an instant before a stroke. In FIG. 3A, the chambers A,A' represent the combustion chambers 12A, 12B just before combustion occurs. The pistons 2,4 bounding the combustion chambers 12A, 12B and the intake chambers 14A, 14B are close together (at TDC) and the pistons 2,4 bounding the compression chambers 16A, 16B and exhaust chambers 18A, 18B are far apart (at BDC). Combustion in chambers 12A, 12B forces the pistons 2,4 bounding these chambers apart. FIG. 36 shows the chambers A,A' just after combustion has occurred. Increased pressure forces against the faces of the two pistons 2,4 forces the pistons 2,4 to move in opposite directions, as indicated by ring-rotation arrows 6A, 6B. All intake-valve pistons 2 in the inner engine ring 10B move together and all exhaust-valve pistons 4 in the outer engine ring 10A move together. As a result, Chambers A,A' now represent exhaust chambers 18A, 18B just before the exhaust stroke occurs in these chambers. It should be clear from this description that each pair of chambers A,A'; B,B'; C,C'; and D,D' undergoes each one of the four strokes as the toroidal IC engine 100 goes through one cycle.

Figure 3B:
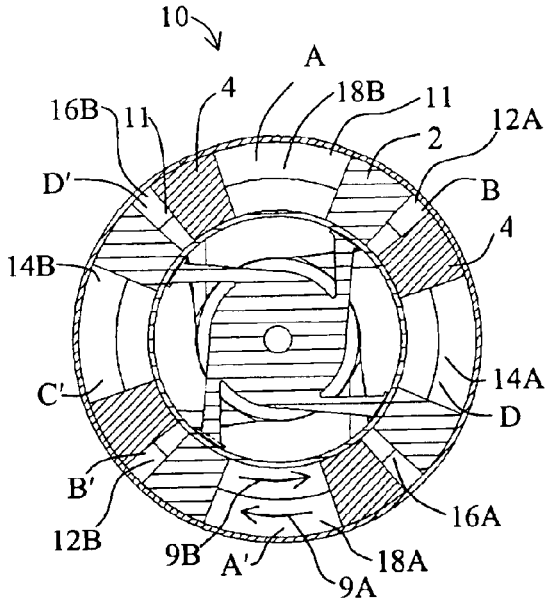
Figure 3C:
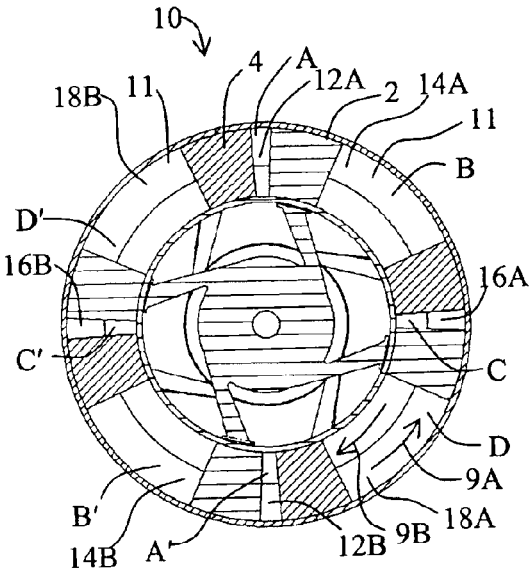
Figure 3D:
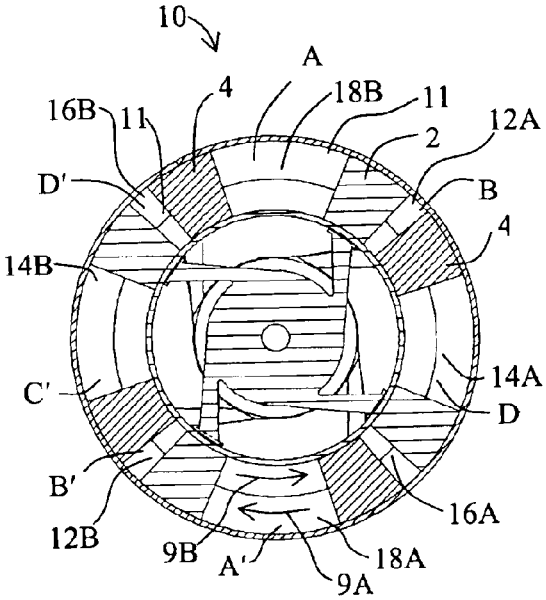

Each of the FIGS. 3A–3D illustrates the relative position of the chambers 11 an instant before a stroke. In FIG. 3A, the chambers A,A' represent the combustion chambers 12A, 12B just before combustion occurs. The pistons 2,4 bounding the combustion chambers 12A, 12B and the intake chambers 14A, 14B are close together (at TDC) and the pistons 2,4 bounding the compression chambers 16A, 16B and exhaust chambers 18A, 18B are far apart. Combustion in chambers 12A, 12B forces the pistons 2,4 bounding these chambers apart. FIG. 3B shows the chambers A,A' just after combustion has occurred. Increased pressure forces against the faces of the two pistons 2,4 forces the pistons 2,4 to move in opposite directions, as indicated by ring-rotation arrows 9A, 9B. All intake-valve pistons 2 in the inner engine ring 10B move together and all exhaust-valve pistons 4 in the outer engine ring 10A move together. As a result, Chambers A,A' now represent exhaust chambers 18A, 18B just before the exhaust stroke occurs in these chambers. It should be clear from this description that each pair of chambers A,A'; B,B'; C,C'; and D,D' undergoes each one of the four strokes as the toroidal IC engine 100 goes through one cycle.

Figure 4:
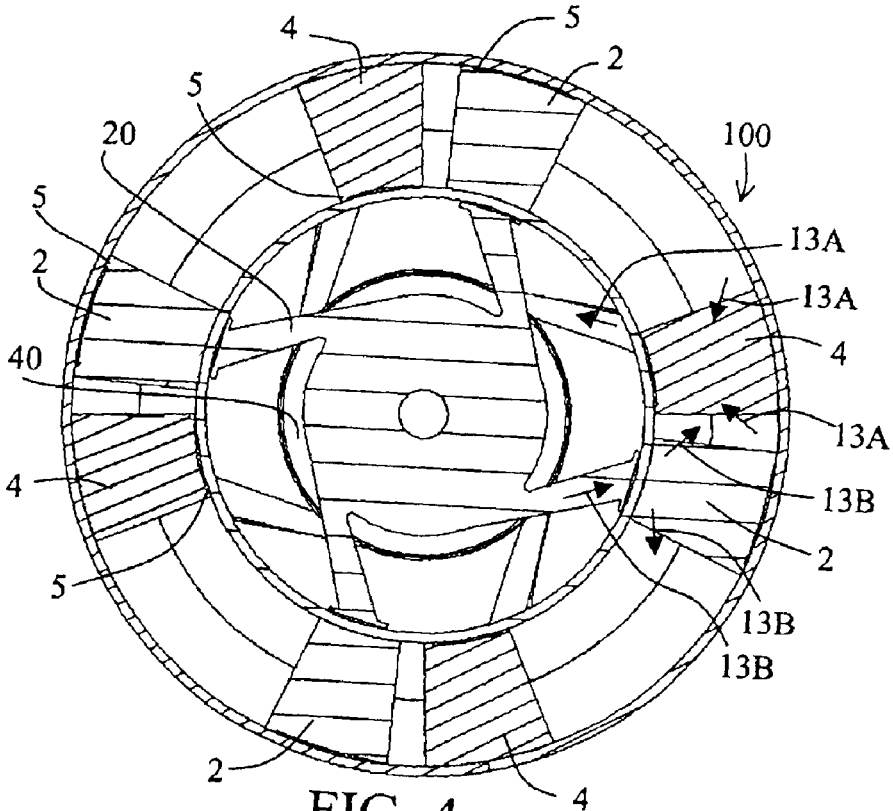
FIG. 4 is a schematic illustration of the arrangement of intake-valve pistons and exhaust-valve pistons in the torus.
Figure 6:
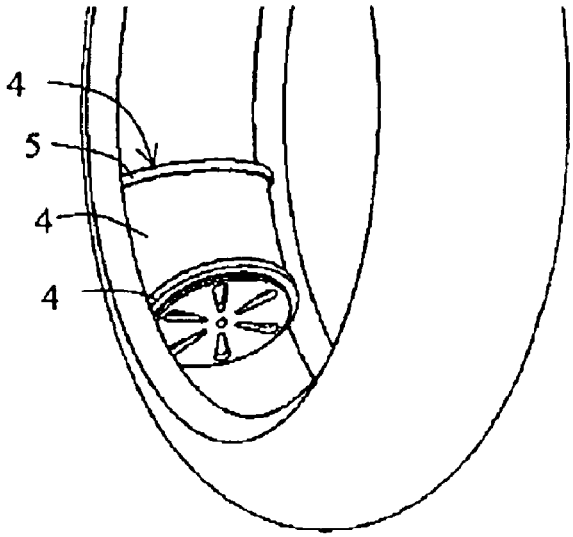
FIG. 6 is an illustration of an exhaust-valve piston in the outer engine ring.

FIG. 4 illustrates a system of mounting the pistons 3 in the torus 10. The intake manifold 20 and the exhaust manifold 40 are shown only schematically and partially. The exhaust manifold 40 is shown to be greater in diameter than the intake manifold 20. This is for illustration purposes and is not a limiting feature of the invention. Four pistons 3 that are the intake-valve pistons 2 are connected to the intake manifold 20 and are fixedly mounted in the inner engine ring 10B. Seal rings 5 encircle the portion of the intake-valve pistons 2 that extend into the outer engine ring 10A. Four pistons 3 that are the exhaust-valve pistons 4 are connected to the exhaust manifold 40 and are fixedly mounted in the outer engine ring 10A. Seal rings 5 encircle the portion of the exhaust-valve pistons 4 that extend into the inner engine ring 10B. As described with FIGS. 3A–3D, the combustion pressures force the exhaust-valve pistons 4, which are all fixedly mounted to the outer engine ring 10A, to move in one direction, which forces the outer engine ring 10A to move in one direction, while the forces on the intake-valve pistons 2, which are all fixedly mounted to the inner engine ring 10B, force the intake-valve pistons 2 to move in the opposite direction, thereby forcing the inner engine ring 10B to rotate in the opposite direction. The seal rings 5 are best seen in FIG. 6. Half of any one piston 3 is affixed to one engine ring, for example, the outer engine ring 10A, while the other half of the piston 3 extends into the other engine ring, i.e., the inner engine ring 10B. The piston 3 must be able to slide along the inner wall of the inner engine ring 10B, without causing undue friction, while at the same time sealing the chamber against gas leakage. In other words, a first half-portion of the piston 3 is fixedly attached to one of the engine rings 10A or 10B, while a second half-portion of the came piston 3 slides along the inner wall of the other of the engine rings 10B or 10A. The seal ring 5 is provided on the second half-portion of the piston 3, as shown in FIGS. 6 and 9.

Figure 5A:
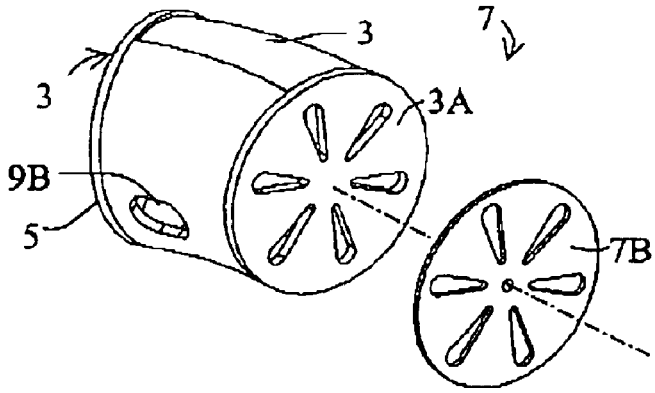
FIG. 5A is an illustration of a slot-type valve in the face of a piston.
Figure 5B:
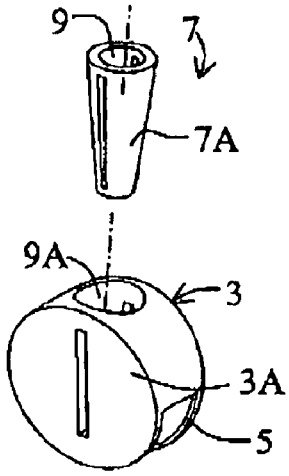
FIG. 5B is an illustration of a slider-type valve in the face of a piston.

It has been mentioned above that the intake valves and exhaust valves are assembled in the piston faces 3A, with only one valve 7 on one piston face 3A. The most suitable types of valves are slot and slide type valves. FIG. 5A illustrates a slider valve 7B, placed in the face 3A of the piston 3 and a port 9, in particular, in intake port 9B, that connects the valve 7 to a passage to the intake manifold 20. FIG. 5B shows a slot valve 7A mounted in an exhaust port 9A.

FIG. 6 is a perspective view of one of the exhaust-valve pistons 4, assembled in the outer engine ring 10A. The inner engine ring 10B is riot shown in this view, for purposes of illustration. As discussed above, each piston 3 has two piston faces 3A,3B and, specifically, each intake-valve piston 2 has two piston faces 2A,2B, and each exhaust-valve piston 4 two piston faces 4A,4B. As shown in FIG. 6, the seal rings 5 are provided on the portion of the exhaust-valve piston 4 that extends into the inner engine ring 10B.

Figure 7:
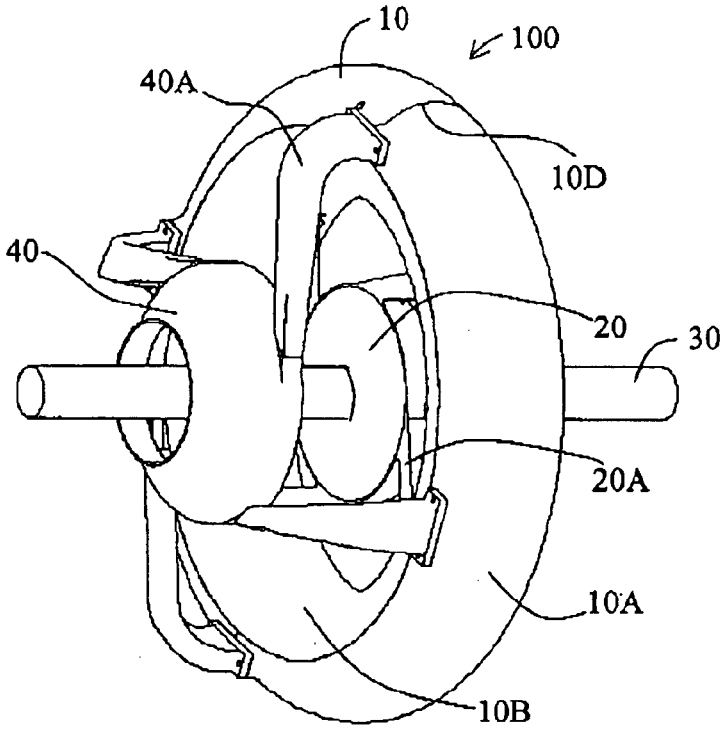
FIG. 7 is a perspective view of the engine according to the invention, assembled with the intake and exhaust manifolds on a shaft.
Figure 9:
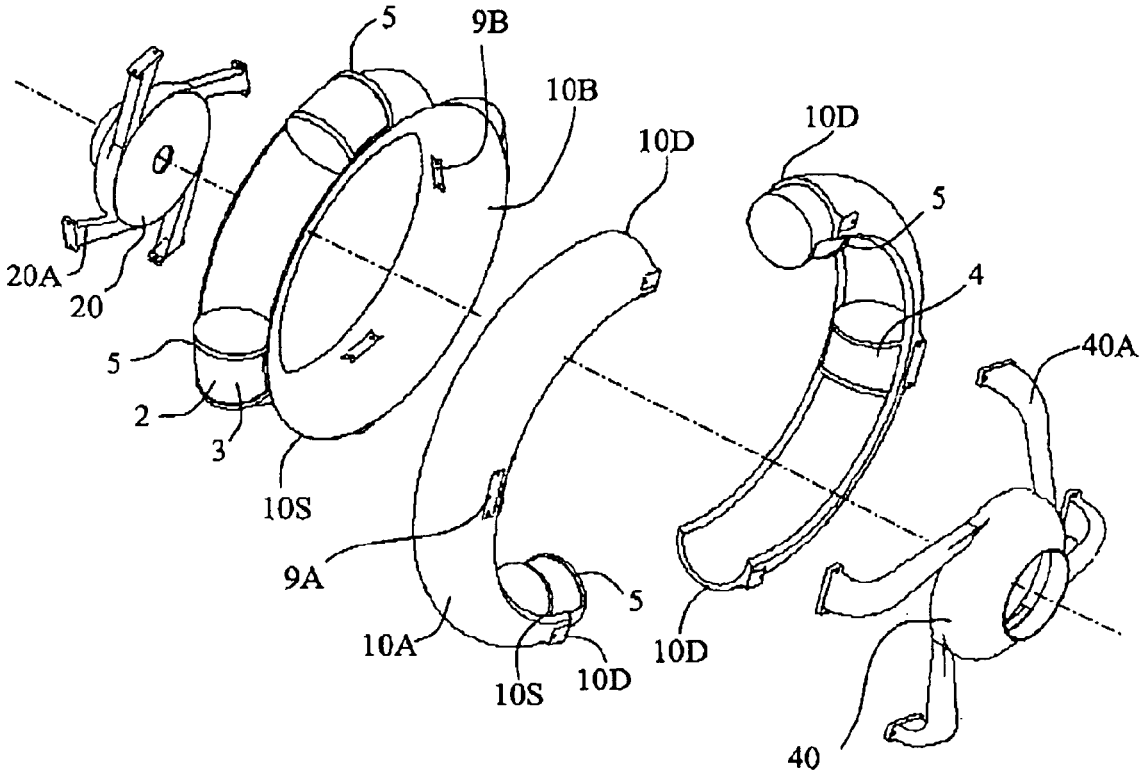
FIG. 9 is an exploded view of the toroidal IC engine acccording to the invention.

FIGS. 7 and 9 illustrate one embodiment of the teroidal IC engine 100 according to the invention, showing the intake manifold 20 and the exhaust manifold 40 mounted on a shaft 30, with the toroidal IC engine 100 supported on the shaft between the manifolds 20,40. As seen, an arm 40A extends from the exhaust manifold 40 to the outer engine ring 10A and connects to the exhaust port 9A on the exhaust-valve piston 4. In FIG. 9 it can be seen that the four exhaust-valve pistons 4 are fixedly attached to the outer ring 10A. 90 degrees apart from each other, while the tour intake-valve pistons 2 are fixedly attached to the inner ring 10B, also 90 degrees apart from each other. Openings are provided in the engine ring 10 at the piston attachment points to provide an open channel for gas flow into or out of the respective pistons 4,2.

FIG. 7 illustrates one embodiment of the toroidal IC engine 100 according to the invention, showing the intake manifold 20 and the exhaust manifold 40 mounted on a shaft 30, with the toroidal IC engine 100 supported on the shaft between the manifolds 20,40. As seen, an arm 20A extends from the intake manifold 20 to the inner engine ring 10B and connects to an intake port 9B on the intake-valve piston 2; an arm 40A extends from the exhaust manifold 40 to the outer engine ring 10A and connects to the exhaust port 9A on the exhaust-valve piston 4.

Figure 8:
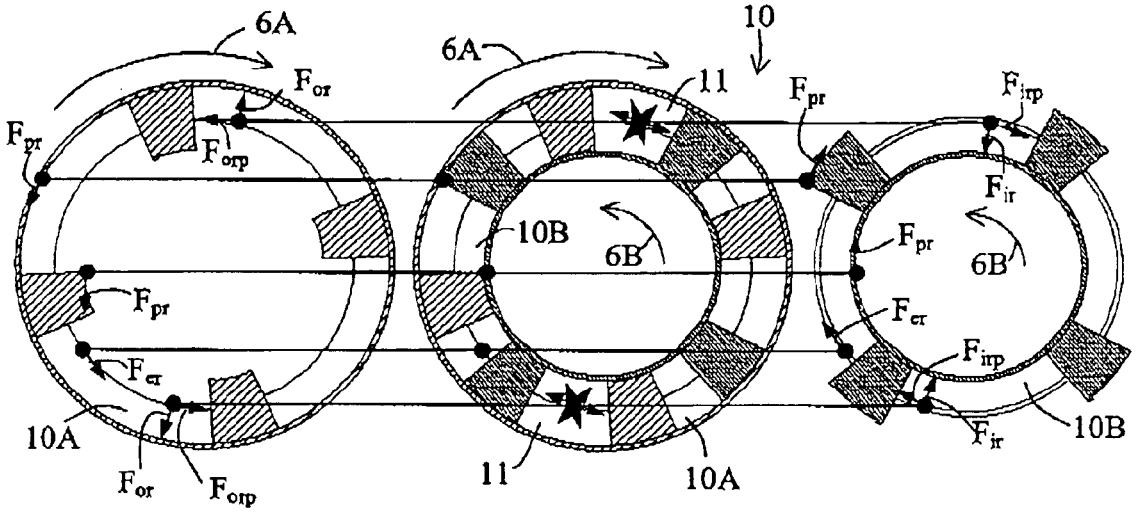
FIG. 8 is a force diagram, showing the forces on the outer ring, assembled engine ring, and the inner ring.

FIG. 8 is a force diagram, illustrating the various forces acting on the torus 10 during the course of the combustion cycle. The forces shown are:

$F_{er}$=Friction Force on Engine Ring $F_{pr}$=Piston Ring Friction $F_{orp}$=Force on Outer Ring Piston $F_{irp}$=Force on Inner Ring Piston $F_{or}$=Force on Outer Engine Ring $F_{ir}$=Force on Inner Engine Ring.

It should be clear from the previous discussion of FIGS. 3A–3D that any two chambers 11 that are going through the same stroke are exactly 180 degrees apart on the engine ring 10. This configuration contributes to the dynamic balancing of the toroidal IC engine 100 according to the invention. As shown in FIG. 8, the force $F_{or}$ on the outer engine ring 10A and the force $F_{ir}$ on the inner engine ring 10B are balanced by equal but opposing forces in the chambers 11. Since two chambers 11 spaced 180 degrees apart undergo the same stroke at the same time, the particular forces at any one instant in those two chambers 11 are 180° apart and apply equal but opposing forces ($F_{orp}$ and $F_{irp}$) to the pistons 3 attached to the outer engine ring 10A and inner engine ring 10B, respectively, in the respective chambers 11. The frictional forces on the engine rings $F_{er}$ are also equally balanced between the inner engine ring 10B and outer engine ring 10A, as is the piston ring friction $F_{pr}$ equally balanced between the inner and outer engine rings 10A and 10B for each piston ring force.

FIG. 9 is an exploded view of the toroidal IC engine 100. The outer engine ring 10A is shown as a split ring having two ring-split seams 10D. Exhaust-valve pistons 4 are fixedly mounted to the concave wall of the outer engine ring 10A. Two of the exhaust-valve pistons 4 are mounted on the outer engine ring 10B right at the junction of the ring-split seam 10D and are used to securely attach the two halves of the outer engine ring 10A around the inner engine ring 108. Intake-valve pistons 2 are fixedly mounted to the concave surface of the inner engine ring 10B. As shown, the face diameter of the intake-valve and exhaust-valve pistons 2, 4, is such that the pistons 2, 4 extend into the inner or outer engine ring to which they are not fixedly attached. The piston ring seals 5 provide a gas-leakage seal between the particular piston 2,4 and the wall of the engine ring along which the piston 2,4 slides. The piston ring seals 5 extend only partially around the pistons 2,4, as best seen on the exhaust-valve pistons 4 that are placed at the ring-split seam 10D. The contour of the surface of the pistons 4 that is fixedly attached to the outer engine ring 10A corresponds to the contour of the inner surface of that outer engine ring 10A, that is, it is without piston ring seals 5. Piston ring seals 5 are shown extending around that portion of the pistons 4 that extends into and slides along the inner engine ring 10B. The piston ring seals 5 are provided analogously on the intake-valve pistons 2, that is, on the portion of the pistons that extends into and slides along the outer engine ring 10A. Also shown in the exploded view are the exhaust and intake manifolds 40, 20.

A preliminary study was completed by the applicant of the present application to determine whether the toroidal IC engine 100 according to the invention could operate at similar power output range of traditional engines. The study considered a 12 inch diameter torus shape, 3.5 inch piston face, and 3.0 inch piston thickness, which provided an engine of approximately 260 $in^3$ swept volume. The toroidal IC engine was to operate at an equivalent 5000 rpms of a traditional engine. The proposed engine ring velocity was assumed sinusoidal, from which an equation for engine ring acceleration was derived. A standard indicator diagram for a spark ignition engine, with a peak pressure of 750 psi, was used for pressures in the chambers of the proposed engine. Estimates for ring seam and piston friction were included in the calculations, and mass inertia was calculated based on an engine construction of carbon-carbon composite (approximate engine weight was calculated to be 35 pounds). The study showed that with the cylinder pressures of the traditional engine, acceleration rates of the engine rings were above those needed to operate at 5000 rpm, indicating that the engine was still producing power. From the calculations, an estimated power output of approximately 600 horsepower was found (neglecting power train and valve losses). Although this study was not complete, it indicates that the toroidal IC engine according to the present invention has a very high potential to provide superior performance compared to the traditional design.

Figure 10:
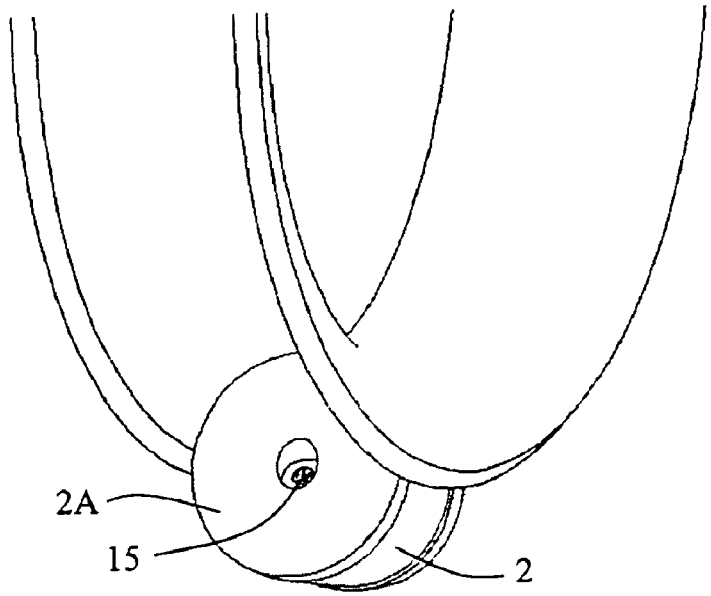
FIG. 10 is an illustration of a piston with a spark plug assembled in the piston face.

FIG. 10 is an illustration of an intake-valve piston 2 with a spark plug 15 assembled in the intake-valve piston face 2A.

Figure 11:
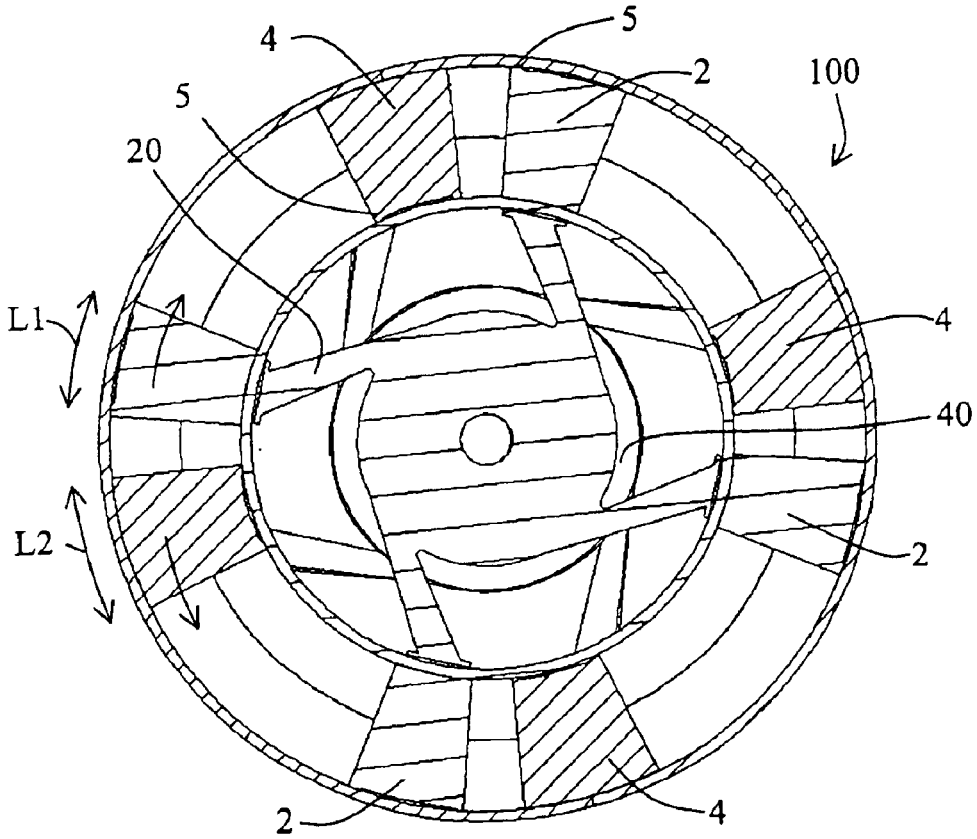
FIG. 11 is an illustration showing the intake-valve pistons having different dimensions from the exhaust-valve pistons.

FIG. 11 is an illustration of the toroidal IC engine 100, showing the set of intake-valve pistons 2 having a length dimension L1 different from a length dimension L2 of the exhaust-valve pistons 4.

Figure 12:
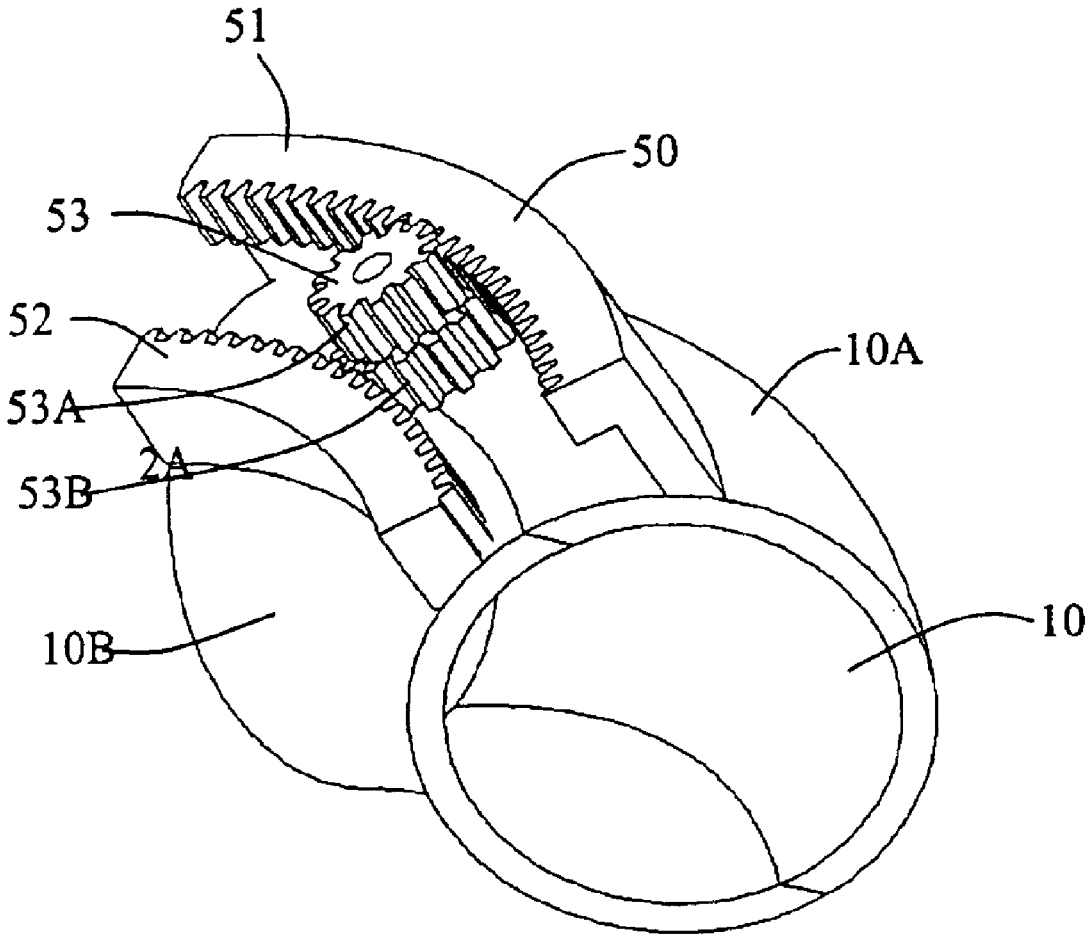
FIG. 12 is an illustration of a gear set that ensures opposite but equal rotation of the inner and outer engine rings.

FIG. 12 illustrates a gear set 50 that is assembled on the engine ring 10 to ensure that the angle of rotation of the engine ring 10 is equal in magnitude for both the outer engine ring 10A and the inner engine ring 10B. The gear set 50 includes a first rack gear 51 that is assembled on the outer engine ring 10A and a second rack gear 52 that is assembled on the inner engine ring 10B. A pinion gear 53, having an outer-ring gear 53A and an inner-ring gear 53B is held between the two rack gears 51, 52, and meshes simultaneously therewith.

The toroidal IC engine 100 according to the invention is preferably constructed of carbon-reinforced carbon (CRC) composite material. In oxygen-exposed areas, the engine surfaces are coated with a coating to prevent oxidation. Silicon carbide, for example, is a suitable coating material that also provides insulative properties, which further reduce the cooling requirements of the engine. It should be noted that no oil lubrication system is shown in the Figures. The toroidal IC engine 100 according to the invention is a self-lubricating engine that requires no oil lubrication system. In the conventional internal combustion engine, a crankshaft for power extraction applies a powerful side thrust to pistons. This side thrust is completely lacking in the toroidal IC engine 100. The use of the composite, self-lubricating CRC material, the even distribution of thermal stresses on the engine due to multiple combustion strokes that take place all around the engine ring in the course of an engine cycle, and the much reduced friction forces due to the lack of the side thrust all contribute to the embodiment of a self-lubricating engine that is continuously operable for extended periods of time with air-cooling and without oil lubrication and oil cooling.

It is understood that the embodiments described herein are merely illustrative of the present invention. Variations in the construction of the toroidal IC engine may be contemplated by one skilled in the art without limiting the intended scope of the invention herein disclosed and as defined by the following claims.

What is claimed is:

1. An internal combustion engine comprising:

an engine ring constructed of two concentric rings, one being an outer engine ring and an other being an inner engine ring, each ring of said two concentric rings having a C-shaped cross-section having a first seam edge, a second seam edge, and an engine ring wall therebetween, wherein said first seam edge of said outer engine ring is sealable with said first seam edge of said inner engine ring, and said second seam edge of said outer engine ring is correspondingly sealable with said second seam edge of said inner engine ring so as to form a torus having an outer circumferential engine wall of a first ring diameter formed by said engine ring wall of said outer engine ring, and an inner circumferential engine wall of a second ring diameter formed by said engine ring wall of said inner engine ring, said first ring diameter being greater than said second ring diameter;

a plurality of pistons including a first piston that is fixedly connected to one of said two concentric rings and a second piston that is fixedly connected to another of said two concentric rings and wherein, when combustion forces in said engine ring force said plurality of pistons to move, both said outer engine ring and said inner engine ring rotate counter to each other; and a gas flow valve for providing gas flow into or out of said engine ring.

2. The internal combustion engine of claim 1, wherein said first piston includes an intake-valve piston and said second piston includes an exhaust-valve piston, and wherein said intake-valve piston and said exhaust-valve piston are assembled within said torus so as to form a chamber between said intake-valve piston and said exhaust-valve piston.

3. The internal combustion engine of claim 2, wherein said gas flow valve is assembled on each piston of said plurality of pistons, and wherein said gas flow valve on said intake-valve piston is an intake valve and on said exhaust-valve piston is an exhaust valve, and wherein gas flow through said engine ring comprises air flow into said chamber through said air intake valve and exhaust flow from said chamber through said exhaust valve.

4. The internal combustion engine of claim 3, wherein said chamber includes a plurality of chambers and said intake-valve piston includes a plurality of intake-valve pistons and said exhaust-valve piston includes a plurality of exhaust-valve pistons, said plurality of exhaust-valve pistons being equal in number to said plurality of intake-valve pistons;

wherein said plurality of intake-valve pistons are spaced evenly apart relative to one another, and wherein said plurality of exhaust-valve pistons are spaced evenly apart relative to one another, said intake-valve pistons and said exhaust-valve pistons being alternately arranged within said engine ring such that each chamber of said plurality of chambers is bounded by one of said intake-valve pistons and one of said exhaust-valve pistons.

5. The internal combustion engine of claim 4, wherein said engine is operable in a mode having a combustion stroke, and wherein said plurality of chambers includes at least one combustion chamber;

wherein, under force exerted by said combustion stroke in said combustion chamber on said one of said intake-valve pistons and said one of said exhaust-valve pistons, said plurality of intake-valve pistons and said plurality of exhaust-valve pistons are forced to move in opposite directions, thereby forcing said combustion chamber to increase in volume and a second chamber that is adjacent to said combustion chamber to decrease in volume.

6. The internal combustion engine of claim 5, wherein said combustion chamber includes at least two combustion chambers spaced equidistant from each other around said engine ring and said combustion stroke takes place essentially simultaneously in said at least two combustion chambers.

7. The internal combustion engine of claim 5, wherein said combustion chamber includes three combustion chambers that are spaced 120 degrees apart from each other.

8. The internal combustion engine of claim 5, wherein said engine ring rotates through an angle of rotation that is fluid-dynamically controlled and not mechanically constricted.

9. The internal combustion engine of claim 3, wherein said gas flow valve is actuated independently of mechanical action of said engine.

10. The internal combustion engine of claim 3, wherein said gas flow valve is a slider valve.

11. The internal combustion engine of claim 3, wherein said piston has a piston face and said gas flow valve is mounted on said piston face.

12. The internal combustion engine of claim 3, wherein said gas flow valve is a slot valve that is mounted within a body of said piston.

13. The internal combustion engine of claim 2 further comprising an intake manifold and an exhaust manifold, wherein said intake-valve piston is connected with said intake manifold so as to allow air to flow from said intake manifold through said intake-valve piston into said engine ring, and said exhaust-valve piston is connected with said exhaust manifold so as to allow exhaust gas to flow from said engine ring through said exhaust-valve piston into said exhaust manifold.

14. The internal combustion engine of claim 13, wherein said engine ring is mounted on a shaft that is inserted through an opening formed by said inner circumferential wall of said inner engine ring.

15. The internal combustion engine of claim 14, wherein said intake manifold and said exhaust manifold are mounted on said shaft.

16. The internal combustion engine of claim 2 further comprising a spark plug, wherein said engine ring is operable in a spark-ignition mode and said spark plug is mounted in said piston face of said intake-valve piston.

17. The internal combustion engine of claim 2, wherein said piston has a length dimension that extends in a direction of rotation of said piston in said engine ring, and wherein said length dimension of said intake-valve piston differs from said length dimension of said exhaust-valve piston.

18. The internal combustion engine of claim 1, wherein material for fabrication of said engine includes a low-expansion material with self-lubricating properties and a low coefficient of thermal expansion.

19. The internal combustion engine of claim 18, wherein said low-expansion material is coated with an insulating and non-oxidizing coating.

20. The internal combustion engine of claim 19, wherein said coating is silicon carbide.

21. The internal combustion engine of claim 18, wherein said low-expansion material is a carbon reinforced-carbon material.

22. The internal combustion engine of claim 1, wherein said engine ring has a self-sealing ring seam that seals said outer engine ring and said inner engine ring.

23. The internal combustion engine of claim 22, wherein said outer engine ring and said inner engine ring each have a seam edge, and wherein said seam edge of said outer engine ring mates with said seam edge of said inner engine ring so as to form an overlapping seam that seals against gas leakage when combustion force is applied against said seam.

24. The internal combustion engine of claim 1 further comprising an engine ring seal that fits between said first seam edge of said first concentric ring and said second concentric ring.

25. The internal combustion engine of claim 1 further comprising an engine ring gear set that links said first concentric ring and said second concentric so as to allow equal but opposite rotation of each of said concentric rings.

26. The internal combustion engine of claim 1 further comprising an air-cooling system and excluding an oil-lubrication-and-cooling system.

27. A self-lubricating internal combustion engine comprising:

an engine ring constructed of two concentric rings, one being an outer engine ring and an other being an inner engine ring, each ring of said two concentric rings having a C-shaped cross-section having a first seam edge, a second seam edge, and an engine ring wall therebetween, wherein said first seam edge of said outer engine ring is sealable with said first seam edge of said inner engine ring, and said second seam edge of said outer engine ring is correspondingly sealable with said second seam edge of said inner engine ring so as to form a torus having an engine-ring cross-section bounded by said engine ring wall of said outer engine ring and by said engine ring wall of said inner engine ring, said engine ring wall of said outer engine ring having an outer ring diameter and said engine ring wall of said inner engine ring having an inner ring diameter that is smaller than said outer ring diameter;

a plurality of pistons that includes a plurality of intake-valve pistons and a plurality of exhaust-valve pistons; wherein said plurality of intake-valve pistons are fixedly connected to a first one of said two concentric rings, said plurality of intake-valve pistons being spaced apart from each other; wherein said plurality of exhaust-valve pistons are fixedly connected to a second one of said two concentric rings, said plurality of exhaust-valve pistons being spaced apart from each other; wherein each piston of said plurality of pistons has a piston body with a piston face at each end of said piston body, said piston body having a cross-section that is slidably and sealably movable in said engine ring, and wherein a first face of a first intake-valve piston and a first face of a first exhaust-valve piston form boundaries for a chamber, wherein, when combustion occurs in said chamber, combustion forces applied to said first intake-valve piston and to said first exhaust-valve piston force said first one and said second one of said two concentric rings to counterrotate, thereby increasing a volume of said chamber and decreasing a volume of an adjacent chamber;

a plurality of gas flow valves; wherein said plurality of gas flow valves corresponds in number to said plurality of pistons, and wherein said plurality of gas flow valves includes an intake valve and an exhaust valve;

an intake manifold;

an exhaust manifold; and and a cooling system for cooling said engine ring, said cooling system including an air-cooling system and excluding an oil-lubrication-and-cooling system;

wherein a gas flow valve of said plurality of gas flow valves is assembled on each piston of said plurality of pistons, said intake valve being assembled directly on said intake-valve piston and said exhaust valve being assembled on said exhaust-valve piston;

wherein said intake valve is gas-flowably connected to said intake manifold so as to control air flow from said intake manifold through said intake-valve piston into said engine ring, and said exhaust valve is gas-flowably connected to said exhaust manifold so as to control exhaust-gas flow from said engine ring through said exhaust-valve piston into said exhaust manifold.

* * * * *

UNITED STATES PATENT AND TRADEMARK OFFICE

CERTIFICATE OF CORRECTION

PATENT NO. : 6,880,494 B2
DATED : April 19, 2005
INVENTOR(S) : Karl V. Hoose

It is certified that error appears in the above-identified patent and that said Letters Patent is hereby corrected as shown below:

Column 10,
Line 17, replace “148” with -- 14B --.
Line 45, replace “FIG. 36” with -- FIG. 3B --.

Column 10, line 58 to Column 11, line 12,
Delete entire paragraph.

Column 11,
Line 44, replace “came” with -- same --.
Line 59, replace “riot” with -- not --.

Column 12,
Line 8, replace “tour” with -- four --.
Line 60, replace “108” with -- 10B --.

Signed and Sealed this

Sixteenth Day of August, 2005

JON W. DUDAS
*Director of the United States Patent and Trademark Office*